United States Patent [19]

Kurano et al.

[11] 4,396,242

[45] Aug. 2, 1983

[54] PLUG CONNECTOR ASSEMBLY

[75] Inventors: Kazuyuki Kurano; Kunio Uchikawa; Toshiyuki Imagawa; Chuji Akasaka, all of Toda, Japan

[73] Assignee: Clarion Co., Ltd., Tokyo, Japan

[21] Appl. No.: 190,606

[22] Filed: Sep. 25, 1980

[30] Foreign Application Priority Data

Sep. 26, 1979 [JP] Japan ..... 54-132722[U]

[51] Int. Cl.[3] ..... H01R 4/66

[52] U.S. Cl. ..... 339/14 R; 339/17 C; 339/182 R; 339/126 J

[58] Field of Search ..... 339/14 R, 14 P, 17 C, 339/182, 183, 166 T, 177 R, 177 E, 256 R, 258 R

[56] References Cited

U.S. PATENT DOCUMENTS 2,992,403 7/1961 Hawk ..... 339/126 J 3,243,760 3/1966 Dupre et al. ..... 339/177 E X 3,936,120 2/1976 Schultz ..... 339/126 J X 4,138,182 2/1979 Muratsuka ..... 339/183 X

*Primary Examiner*—Eugene F. Desmond

*Attorney, Agent, or Firm*—Wallenstein, Wagner, Hattis, Strampel & Aubel

[57] ABSTRACT

A connector assembly for a plug comprised of a metal pin connected to a core of a cable having a shielding sheath and an earth member shell insulated from the pin and connected to the shielding sheath of the cable, which device is characterized in that a metal sleeve for receiving the earth member therein so as to be in contact therewith in fixed and electrically connected to a casing of an electronic apparatus, a printed circuit board is disposed at a position opposite to the metal sleeve and a resilient member electrically connectable to the pin of the plug is provided on the printed circuit board.

3 Claims, 2 Drawing Figures

PLUG CONNECTOR ASSEMBLY

BACKGROUND OF THE INVENTION

1. Field of the Invention

This invention relates to a jack assembly provided on an electronic apparatus for receiving a plug therein, and more particularly to a jack assembly for an antenna of a car radio receiver or the like.

2. Description of the Prior Art

A conventional plug connector assembly, especially, a known antenna jack assembly of a car radio receiver, has generally a structure as illustrated in FIG. 1. In FIG. 1, 1 is a metal casing of a radio receiver, 2 an antenna jack, 3 an earth member of the antenna jack, 4 a member connected to a pin 4', 5 a hook formed by cutting and raising a portion of the casing 1 for holding the antenna jack 2, 6 solder, and 7 a lead wire. As can be seen from FIG. 1, the antenna jack 2 is fixed to the casing 1 by the hooks 5 in cooperation with the solder 6 and the earth member 3 is electrically connected to the casing 1 through the hooks 5. In the arrangement as illustrated in FIG. 1, since the jack 2 is held by the two hooks raised from the casing 1, the position for mounting the jack 2 is limited to corners of the casing 1. In addition, the arrangement requires soldering of the hooks 5 to the earth member 3 and further requires the lead wire for connecting the antenna pin 4' to an electric circuit.

OBJECT OF THE INVENTION

It is therefore an object of the present invention to provide a plug connector assembly capable of obviating the aforesaid disadvantages, in which an each member is fitted in and kept in contact with a metal cylinder fixed to a casing.

It is another object of the present invention to provide a plug connector assembly in which the center conductor pin of a cable is kept in resilient contact with a resilient member provided on a printed circuit board in a casing.

SUMMARY OF THE INVENTION

In accordance with the present invention, there is provided a plug connector assembly comprising a cable having a shielding sheath; a metal pin connected to the center conductor of the cable; a metal earth member shell insulated from the pin and connected to the shielding sheath of the cable; and a metal cylindrical sleeve for receiving the earth member shell therein so as to be in contact therewith, said sleeve being fixed and electrically connected to a metal casing of an electronic apparatus.

DESCRIPTION OF THE EMBODIMENT

Figure 1:
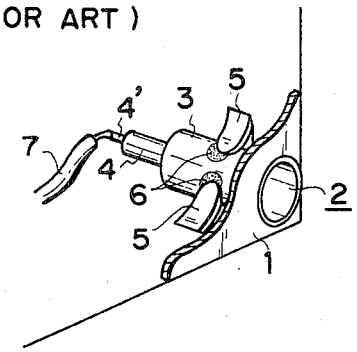
FIG. 1 (PRIOR ART)
FIG. 1 is a perspective view of a conventional plug connector assembly.
Figure 2:
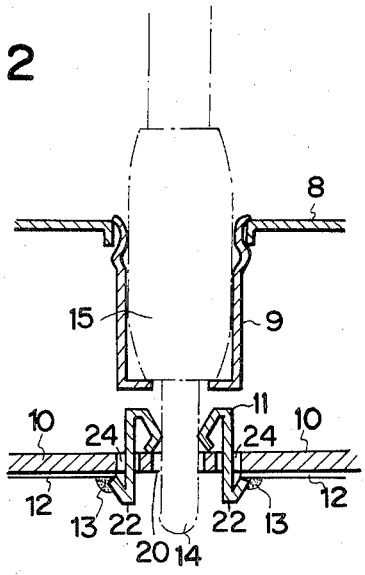
FIG. 2 is a sectional view of a plug connector assembly in accordance with the present invention.

Referring now to FIG. 2, there is illustrated a plug connector assembly embodying the present invention. Numeral 8 is a metal casing of an electronic apparatus, 9 is a metal cylindrical sleeve for receiving a metal earth member shell 15 of a plug therein. The plug is connected to a cable having a shielding sheath and has a metal pin 14 connected to the center conductor of the cable. The metal earth member shell 15 is insulated from the pin 14 and connected to the shielding sheath of the cable. 10 is a printed circuit board, 11 is a resilient conductive member, 12 is a copper foil provided on a rear face of the printed circuit board 10, and 13 is a solder for electrically connecting the resilient member 11 to the copper foil 12. An opening is formed on the casing for receiving the sleeve 9 therein and the casing 8 and sleeve 9 are configured in overlapping engagement to fix and electrically connect the metal sleeve 9 to the casing 8. The printed circuit board 10 is disposed opposite to the metal sleeve 9 and has an opening for allowing the pin 14 of the plug to be inserted therethrough. The resilient member 11 is disposed around the opening 20 so as to resiliently contact the pin 14. Prong-like portions 22—22 of the resilient member 11 pass through passages 24—24 to be soldered to the copper foil 12 of the printed circuit board 10 to fix and electrically connect the resilient member 11 to the copper foil 12.

The material of the casing 8 of the electronic apparatus is not limited to a metal but the casing 8 may be formed of a resin etc. In the latter case, the casing 8 is required to have a structure which allows the metal sleeve 9 to be electrically connected to an earth point, e.g., a chassis inside the casing 8 as well as to be fixed to the casing 8.

In accordance with the present invention as described above, since the resilient member 11 resiliently contacting the pin 14 is disposed on the printed circuit board 10, a lead wire for connecting the pin 14 to an electric circuit can be omitted. In addition, since the metal sleeve 9 is fixed by overlapping engagement with the casing 8, the position and the material of the connector assembly are by no means subject to restriction and may be selected freely.

We claim:

1. In a two-member coaxial cable receiving connector configured to insertingly contactingly accept a coaxial cable end connector provided with a metal grounding member shell mounted on the end of said cable and making contact to the shielding sheath therearound and with a metal pin making contact to the central conductor of said cable, the first member of said cable-receiving connector being in the form of a conducting shell configured to insertingly contactingly receive said grounding shell member and mountable on a casing of an electrical apparatus and having provision for electrical contact thereto, the second member of said cable-receiving connector being a separate one-piece conductive resilient member configured for making resilient contact with said pin along an insertion engagement axis, said second member having mounting means for mounting said second member on a printed circuit board of said electrical apparatus with said insertion axis disposed along the axis of said sleeve so that said resilient member is in contact with said metal pin when said shell is fully received in said sleeve, said resilient member comprising a plurality of spring-like inwardly facing spring projections disposed about said insertion engagement axis and configured to insertingly contactingly accept said pin, the improvement wherein:

said mounting means of said resilient member comprises prong means configured to pass by insertion through passage means in said circuit board, said prong means fastened to a conductive layer on said board so as to provide electrical connection from said spring projections to said conducting layer.

2. The assembly of claim 1 wherein end portions of said spring projections are in touching engagement with the insertion face of said circuit board.

3. The apparatus of claims 1 or 2 wherein the end portions of said prong means passing beyond said board are rearwardly folded to press against said conducting layer.

* * * * *